United States Patent [19]

Tseng

[11] Patent Number: 4,658,606

[45] Date of Patent: Apr. 21, 1987

[54] LOCK CENTERS AND KEYS FOR PADLOCKS

[76] Inventor: Chin-Shan Tseng, 10-3, Cheng Shin, Pin Tung, Taiwan

[21] Appl. No.: 523,570

[22] Filed: Aug. 16, 1983

[51] Int. Cl.[4] ..... E05B 67/22

[52] U.S. Cl. ..... 70/38 A; 70/358; 70/367; 70/371; 70/404; 70/409; 70/DIG. 57

[58] Field of Search ..... 70/38 A, 38 B, 38 C, 70/38 R, 39, 358, 364 A, 386, 401–404, 409, 350–352, DIG. 57, 363, 370, 421, 371, 367

[56] References Cited

U.S. PATENT DOCUMENTS

| | | | |
|---|---|---|---|
| 1,052,105 | 2/1913 | Van Hoesen | 70/401 X |
| 1,173,677 | 2/1916 | Müller | 70/363 |
| 1,228,129 | 5/1917 | Patton | 70/401 X |
| 1,477,318 | 7/1922 | Crass | 70/404 |
| 1,891,214 | 12/1932 | Falk | 70/363 |
| 1,983,747 | 11/1923 | Gahagan | 70/38 B |
| 2,557,028 | 6/1951 | Deutsch | 70/363 |
| 2,618,957 | 11/1952 | Tonnessen | 70/363 |
| 2,720,103 | 10/1955 | Golden et al. | 70/370 |
| 3,172,279 | 3/1965 | Patriquin | 70/38 A |
| 3,221,526 | 7/1962 | Stackhouse | 70/38 A |
| 3,855,824 | 12/1974 | Falk | 70/38 A |
| 4,321,811 | 3/1982 | Ziegler | 70/364 A X |
| 4,341,102 | 7/1982 | Ku et al. | 70/421 |
| 4,351,171 | 9/1982 | Tsui | 70/38 R X |
| 4,407,147 | 10/1983 | Larson | 70/409 X |
| 4,445,347 | 5/1984 | Tseng | 70/421 X |

FOREIGN PATENT DOCUMENTS

| | | | |
|---|---|---|---|
| 906230 | 12/1945 | France | 70/38 B |
| 413960 | 6/1946 | Italy | 70/38 B |
| 718451 | 11/1954 | United Kingdom | 70/421 |

*Primary Examiner*—Robert L. Wolfe
*Assistant Examiner*—Lloyd A. Gall
*Attorney, Agent, or Firm*—Larson and Taylor

[57] ABSTRACT

A new lock center combined with a cylindrical barrel for use in a padlock. The padlock is provided with a key having a plurality of arc-shaped teeth which can engage a corresponding number and shape of slots in the lock center. Two resiliently retained pins located in aligned vertical pin holes in the barrel and lock center prevent relative rotation of the lock center and barrel. However, by inserting and rotating the key in the lock center, the arc-shaped teeth of the key engage the pins and align the line of contact between the two pins with the line of contact between the lock center and the cylindrical barrel, thereby permitting the lock center to rotate relative to the barrel. Upon rotation of the lock center, the thinner shoulder of the upper part of the lock center is rotated between two steel balls, which then can roll out of contact with the lock shackle toward the thinner shoulder and permit the shackle to be open by spring pressure.

9 Claims, 16 Drawing Figures

LOCK CENTERS AND KEYS FOR PADLOCKS

CROSS-REFERENCED TO RELATED APPLICATIONS

The present invention is an improvement on the invention disclosed and claimed in U.S. patent application Ser. No. 278,055 filed June 29, 1981 by the present inventor, now U.S. Pat. No. 4,445,347 granted May 1, 1984.

1. Field of the Invention

The present invention relates to an improvement in padlocks.

2. Background of the Invention

There is a need to provide padlocks which provide a higher degree of safety against burglary.

DESCRIPTION OF THE PREFERRED EMBODIMENTS

Figure 1:
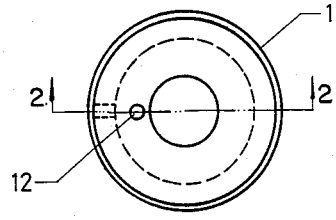
FIG. 1 is a top plan view of the cylindrical barrel according to the present invention.
Figure 2:
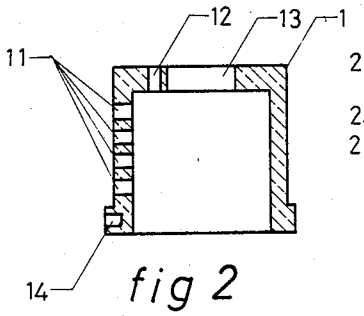
FIG. 2 is a cross-sectional view taken along line 2—2 of FIG. 1.

As shown in FIGS. 1 and 2, a hollow cylindrical barrel is provided with a bore therethrough having a larger opening at the bottom than at the top, thereby providing an annular ring around the top opening. Barrel 1 is provided with a plurality of pin holes 11 arranged in a vertical column in the wall thereof, which is shown at the left side wall segment as depicted in FIG. 2. Barrel 1 is also provided with a pin hole 12 located in the top annular rim adjacent to the column of pin holes 11, and a central lock hole bore is also located in the top of barrel 1 and defined by the edges of the annular rim. A bolt hole 14 is located beneath the lowest most pin hole 11, also shown on the left hand wall section in FIG. 2.

Figure 3:
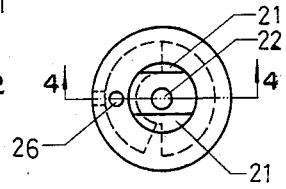
FIG. 3 is a top plan view of a lock center of the present invention.
Figure 4:
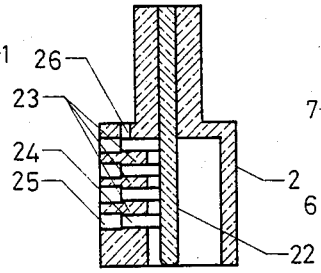
FIG. 4 is a cross-sectional view taken along line 4—4 of FIG. 3.
Figure 5:
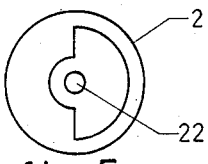
FIG. 5 is a bottom plan view of the lock center depicted in FIG. 3.

With reference now to FIGS. 3, 4 and 5, a lock center 2 is depicted. Lock center 2 has a shape that conforms to the inner bore of barrel 1 and thus is provided with a smaller upper portion and a larger lower portion. The upper portion has a portion removed therefrom on two opposing sides so as to provide shoulders 21. Located in the middle of lock center 2 is a vertically mounted bar 22. On one side of bar 22 in the larger portion of lock center 2, which is depicted as being on the right side in FIG. 4, is a cavity, and on the other side, which is the left side as depicted in FIG. 4, are located a plurality of arc-shaped teeth 23. Teeth 23 are equally spaced apart, thereby forming a plurality of semi-annular slots 24 which extend to a plurality of corresponding pin holes 25. Located on the upper surface of the annular rim of the larger portion of lock center 2 is a vertically oriented pin hole 26.

Figure 6:
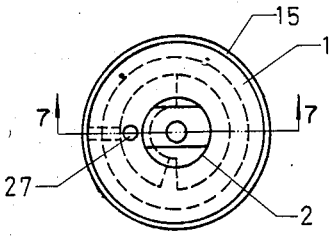
FIG. 6 is a top plan view of the cylindrical barrel combined with the lock center according to the present invention.
Figure 7:
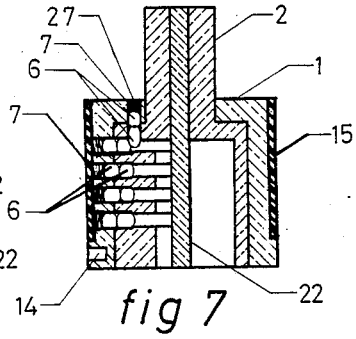
FIG. 7 is a cross-sectional view taken along line 7—7 of FIG. 6.

In FIGS. 6 and 7, barrel 1 and lock center 2 are shown assembled and further include a plurality of pairs of pins 6 and springs 7 inserted in pin holes 11 and 25, and 12 and 26. A tubular plastic cover 15 is located around the outer wall of cylindrical barrel 1, and retains pins 6 and springs 7 inside their respective pin holes 11 and 25 and thereby preventing them from falling out. A seal cap 27 is tightly mounted in seal hole 12 of barrel 1 and retains the corresponding pair of pins 6 and springs 7 inside pin holes 12 and 26.

Figure 8:
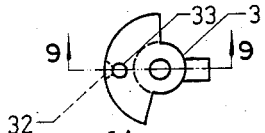
FIG. 8 is a top plan view of a key according to the present invention usable with the cylindrical barrel and lock center of the present invention.
Figure 9:
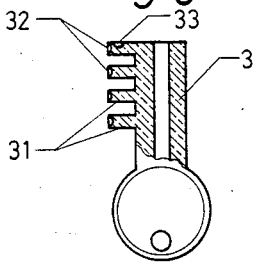
FIG. 9 is a cross-sectional view taken along line 9—9 of FIG. 8.

With reference to FIGS. 8 and 9, there is depicted a key 3 which has a shape of a circular pipe with a plurality of arc-shaped teeth 31 mounted around part of the exterior wall. The number of teeth 31 equals the number of slots 24 in lock center 2. Each tooth 31 is provided with a tiny recess 32 at its outermost tip to receive corresponding pins 6 in pin holes 11 and 25. The outermost tooth 31 on its outermost or top surface as depicted in FIG. 9 is provided with a tiny recess 33 for engaging the lowermost pin 6 installed in recess 26.

Figure 10:
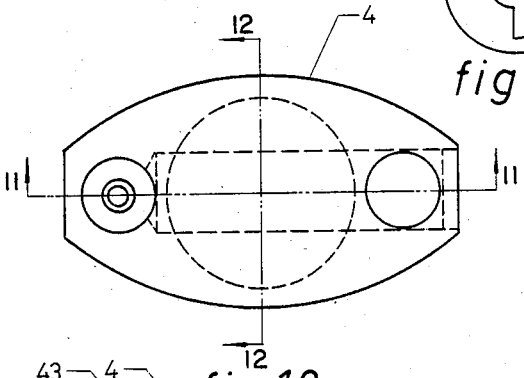
FIG. 10 is a top plan view of a lock body.
Figure 11:
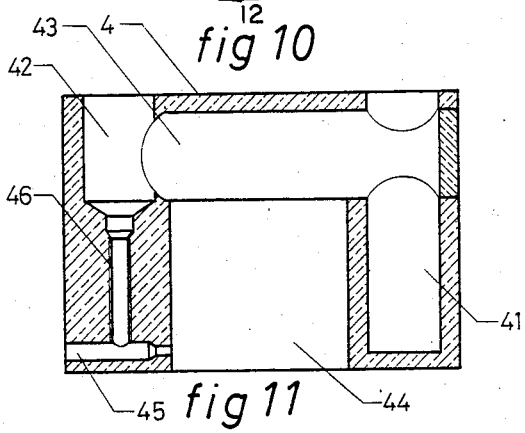
FIG. 11 is a cross-sectional view taken along line 11—11 of FIG. 10.
Figure 12:
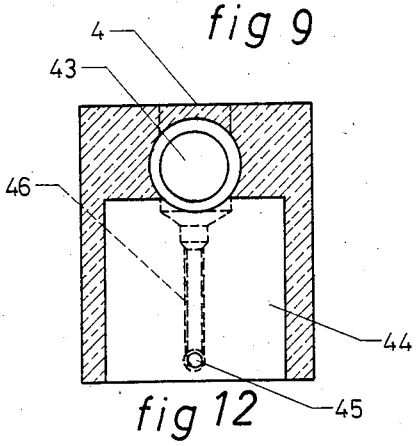
FIG. 12 is a cross-sectional view taken along line 12—12 of FIG. 10.
Figure 14:
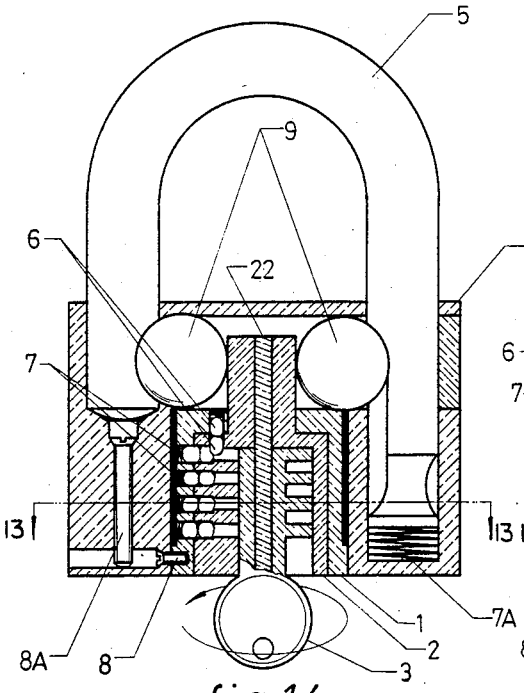
FIG. 14 is a front elevational, cross-sectional view of the padlock according to the present invention depicted in the locked condition.
Figure 16:
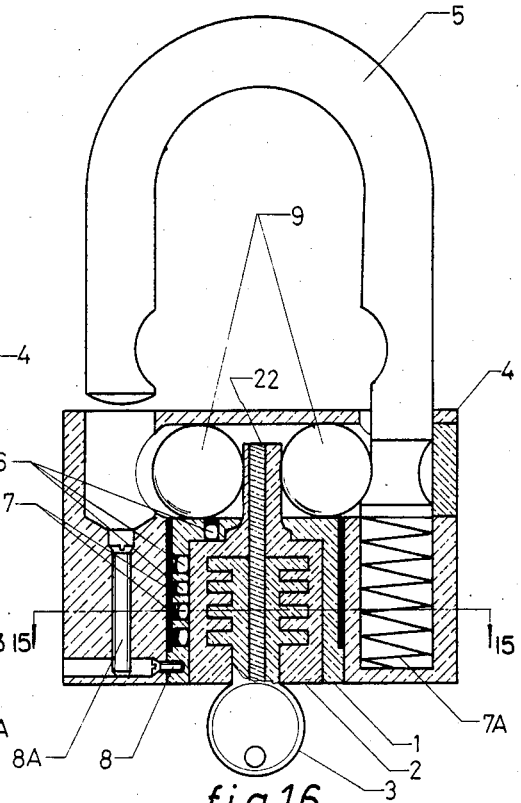
FIG. 16 is a front elevational, cross-sectional view of the padlock depicted in the opened condition.

With reference now to FIGS. 10, 11 and 12, the structure of a lock body 4 is depicted. Lock body 4 is provided with a longer bore 41 and a shorter bore 42 for mounting a shackle 5 (as depicted in FIGS. 14 and 16). As depicted in FIG. 11, bores 41 and 42 are generally vertical and extend in substantially the same direction. A transverse bore 43, which extends horizontally as depicted in FIG. 11 between bores 41 and 42, has a size to accommodate corresponding steel balls 9 (see FIGS. 14 and 16). Lock body 4 is also provided with a center bore 44 for receiving the combined barrel 1 and lock center 2, and two bolt holes or bores 45 and 46. Bolt hole 45, as shown in FIG. 11, extends horizontally from the outside of lock body 4 to center bore 44, and bolt hole 46, as shown in FIG. 11, extends vertically from a mid-portion of bolt hole 45 to shorter bore 42.

Figure 13:
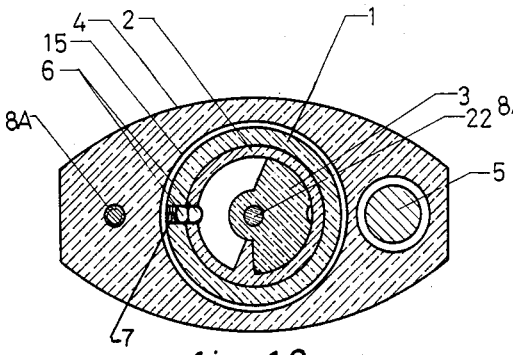
FIG. 13 is a cross-sectional view taken along line 13—13 of FIG. 14.
Figure 15:
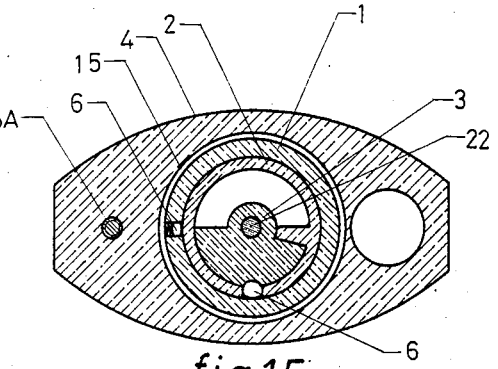
FIG. 15 is a cross-sectional view taken along line 15—15 of FIG. 16.

With reference to FIGS. 13–16, a padlock incorporating the present invention is depicted with all of the parts mounted together and shown in the locked position with key 3 installed in FIGS. 13 and 14. FIGS. 15 and 16 show the same components, but with key 3 turned and the lock in the unlocked condition.

Also shown in FIGS. 13–16 are a large spring 7A located in longer bore 41 of lock body 4, and a U-shaped shackle 5 having a longer leg and a shorter leg is installed with the larger leg compressingly engaging spring 7A. Steel balls 9 are installed in transverse bore 43, and engage recesses in the longer and shorter shackle legs located on either side of the smaller portion of lock center 2 in engagement with the thicker diameter part. A bolt 8 is located in horizontal bolt hole 45 and extends into bolt hole 14 of barrel 1, which has been aligned with bolt hole 45. A second, larger bolt 8A is mounted in bolt hole 46. Bolt 8A has its tip inserted into bottom hole 45, thereby preventing bolt 8 from being accessible and unscrewed.

The lock is assembled by first installing spring 7A in larger hole 41 and then installing shackle 5. Next steel balls 9 are inserted into transverse bore 43 and the combined barrel 1 and lock center 2 is inserted into center bore 44 such that one steel ball 9 is located on either side of the smaller, upper part of lock center 2. Barrel 1 is then locked in place by screwing bolt 8 into the aligned holes 45 and 14. Lastly, bolt 8A is installed in bolt hole 46 to complete the assembly.

In use, after key 3 is inserted in lock center 2, key 3 is rotated in the direction depicted in FIG. 14 for a predetermined angle which permits arc-shaped teeth 31 to engage and be received by semi-annular slots 24, as shown in FIG. 16. Key 3 is rotated to the position to engage the pins 6 in pin holes 25 and 26, and continued rotation forces the pins upwardly as shown in FIG. 14 so that the line where upper pin 6 meets lower pin 6 becomes aligned with the line that separates lock center 2 from barrel 1. Continued rotation of key 3 now causes lock center 2 to also be rotated in the same direction. When lock center 2 is rotated, the thinner part of shoulders 21 of lock center 2 is placed between steel balls 9, thereby providing more space for balls 9 to roll toward the shoulders, and thereby releasing shackle 5. Shackle 5 is then pushed outwardly and upwardly, as depicted in FIG. 16, by large spring 7A, thereby unlocking the lock.

I claim:

1. Lock components for use in a padlock, said components comprising:

a cylindrical, hollow barrel having a side wall, the inner surface of which defines a lock center bore, and a radially inwardly extending flange having a lock hole bore extendinging therethrough and communicating with said lock center bore, said barrel side wall having a plurality of radial pin holes therein each in communication with said lock center bore and said barrel flange having a axial pin hole therein in communication with said lock center bore; and a lock center rotatably mounted in said barrel lock center bore, said lock center having a plurality of axially arranged arc-shaped teeth located on one side as seen in an axial cross-section, said teeth defining a plurality of slots therebetween, said lock center having a plurality of radial lock center pin holes, each lock center pin hole corresponding to one of said barrel pin holes so as to be radially alignable and in communication therewith, and said lock center also having an axial lock center pin hole corresponding to said barrel flange pin hole and located in said tooth closest to said barrel flange.

2. Lock components as claimed in claim 1 and further comprising a pair of radial pins resiliently mounted in at least one of said radial barrel and lock center pin holes when aligned and a pair of axial pins resiliently mounted in said axial barrel and lock center pin hole when aligned so as to prevent relative rotation of said barrel and lock center, said pairs of pins capable of being moved in said pin holes by a key such that one of said pair is in said barrel pin hole while the other of said pair is in said lock center pin hole so that relative rotation of said barrel and lock center is permitted.

3. Lock components as claimed in claim 1 wherein said lock center has an internal cavity on the other side thereof; and wherein said arc-shaped teeth are equally spaced apart in the axial direction so as tof orm a plurality of semi-annular slots.

4. Lock components as claimed in claim 3 wherein said slots are aligned and in communication with corresponding ones of the radially extending pin holes.

5. Lock components as claimed in claim 1, said barrel further including means for being fixedly retained inside a lock body.

6. Lock components as claimed in claim 5 and further including a padlock housing having a center cavity for receiving said barrel and lock center combinated.

7. Lock components as claimed in claim 6 said housing having a rdially extending bore therethrough and an axially extending bore, the inner end of which communicates with a central portion of said radially extending bore;

said barrel retaining means including a screw hole in the outer side thereof in radial alignment with said housing radially extending bore; and said lock components further including a screw mounted in said aligned radially extending bore and said screw hole; and a bolt mounted in said axially extending bore so as to prevent said screw from being removed.

8. Lock components as claimed in claim in claim 2 and further including means for blocking the outermost entrance of said barrel pin holes so as to retain said pins therein.

9. Lock components as claimed in claim 2 and further comprising a key having a shape corresponding to and mating with said lock center so that said key can be inserted into said lock center cavity and rotated therein, said key having a plurality of arc-shaped teeth corresponding to and insertable in said lock center slots, each of said key teeth having a recess located on the tip thereof for engaging the innermost radial pin and the radially outermost key tooth having a recess on the outermost surface thereof for engaging the innermost one of the axial pins.

* * * * *